US008308507B2

(12) United States Patent
Lin

(10) Patent No.: US 8,308,507 B2
(45) Date of Patent: Nov. 13, 2012

(54) KVM CABLE WITH VIDEO CONNECTORS, PS/2 CONNECTORS AND USB CONNECTOR

(75) Inventor: Chin-Chang Lin, Taipei (TW)

(73) Assignee: Action Star Enterprise, Co. Ltd. (TW)

( * ) Notice: Subject to any disclaimer, the term of this patent is extended or adjusted under 35 U.S.C. 154(b) by 172 days.

(21) Appl. No.: 13/017,051

(22) Filed: Jan. 31, 2011

(65) Prior Publication Data

US 2012/0196475 A1 Aug. 2, 2012

(51) Int. Cl.
*H01R 11/00* (2006.01)

(52) U.S. Cl. ..... 439/502; 439/540.1

(58) Field of Classification Search ..... 439/502, 439/540.1, 623

See application file for complete search history.

(56) References Cited

U.S. PATENT DOCUMENTS 6,913,482 B1 * 7/2005 Wu ..... 439/502
7,229,302 B1 * 6/2007 Lai ..... 439/214
7,572,143 B2 * 8/2009 Harris et al. ..... 439/502
7,611,367 B2 * 11/2009 Lee ..... 439/218

* cited by examiner

*Primary Examiner* — Hien Vu

(57) ABSTRACT

The present invention relates to a KVM cable with video connectors, PS/2 connectors and USB connector capable of connecting to a computer and a KVM device, the KVM cable comprises: a first video connector, a second video connector, a main cable, a first branch cable, a first PS/2 connector, a second branch cable, a second PS/2 connector, and at least one USB connector. In the KVM cable, the un-used pins, the ground pins and the un-connected pins of the video connector are utilized, and a detecting resistor and a diode device are disposed in the USB connector; so that, when the KVM cable is used, a user can selectively connect the PS/2 connector or the USB connector of the KVM cable to the computer, so as to control two or more computers through the KVM device.

9 Claims, 5 Drawing Sheets

KVM CABLE WITH VIDEO CONNECTORS, PS/2 CONNECTORS AND USB CONNECTOR

BACKGROUND OF THE INVENTION

1. Technical Field

The present invention relates to a KVM cable with multi functions, and more particularly, to a KVM cable with video connectors, PS/2 connectors and USB connector.

2. Description of Related Art

With development of the information science and technology, computers are widely used and applied, such as families, studios, companies, and enterprises, which all use the computers to deal with affairs and routine works. Moreover, based on the need of work, a single user may use two or more computers at the same time; meanwhile, the user usually uses a KVM device for connecting the two or more computers; therefore, the two or more computers are able to share one keyboard, one mouse and one display, so as to facilitate the user to simultaneously control the two computers.

Besides, computer venders propose a KVM cable with multi functions for meeting and being compatible with the cables with different connector interfaces, for example, a VGA connector cable used for connecting the display and a PS/2 connector cable applied in keyboard/mouse; thus, through the KVM cable with multi functions, the number of the connector cables can be reduced when the user uses the KVM device. Please refer to FIG. 1, which illustrates a top view of a conventional KVM cable with multi functions. As shown in FIG. 1, the KVM cable 1' with multi functions includes: a first video connector 11', a second video connector 12', a main cable 13', a keyboard PS/2 connector 14', a first branch cable 15', a mouse PS/2 connector 16', and a second branch cable 17'.

Continuously referring to FIG. 1, in the KVM cable 1', the first video connector 11' is used for connecting to a KVM device 2', and the second video connector 12' is connected with the first video connector 11' via the main cable 13', wherein the second video connector 12' is used for connecting to a video connection port 31' of a computer 3'. Besides, two branch cables extend from the main cable 13' and are near to the second video connector 12', the two branch cables are the first branch cable 15' and the second branch cable 17', respectively. The keyboard PS/2 connector 14' and the mouse PS/2 connector 16' are connected with the main cable 13' through the first branch cable 15' and the second branch cable 17', respectively, wherein the keyboard PS/2 connector 14' is used for connecting the keyboard PS/2 connection port of the computer 3', and the mouse PS/2 connector 16' is used for connecting the mouse PS/2 connection port of the computer 3'. Therefore, through the conventional KVM cable 1' with multi functions, the user can not need to prepare two PS/2 cables for connecting to the computer 3' when the KVM device 2' is used.

In addition, it is well known that the commercial keyboards/mice sold in the market are not only the keyboards/mice with PS/2 interface; the market also sells the keyboards/mice with USB interface. Please refer to FIG. 2, which illustrates the top view of the conventional KVM cable with multi functions and an USB connector. As shown in FIG. 1 and FIG. 2, for making the KVM cable 1' with multi functions able to be compatible with the USB connection port of the computer 3', an USB connector 14*a'* is substituted for the keyboard PS/2 connector 14' and the mouse PS/2 connector 16'; so that, the user can connect the USB connector 14*a'* to the USB connection port of the computer 3'; However, in the KVM cable 1' shown as FIG. 2, it can merely carry with the USB connector 14*a'*.

Although the two conventional KVM cables 1' shown in FIG. 1 and FIG. 2 may satisfy the user with different needs, the user can not use the KVM cable 1' to connecting the KVM device 2' and the computer 3' if the mouse and the keyboard connected to the computer 3' are the mouse with USB interface and the keyboard with USB interface; in this condition, the user must go to purchase one keyboard with USB interface or one mouse with PS/2 interface, and then the user can use the KVM cable 1' for transmitting signal between the KVM device 2' and the computer 3'; however, it is easily to know that is very inconvenient for user.

Thus, according to the above description, it can easily understand that the conventional KVM cables with multi functions still have shortcomings and drawbacks; accordingly, in order to solve the shortcomings and drawbacks of the conventional KVM cables, the inventor of the present application has made great efforts to make inventive research thereon and eventually provided an a KVM cable with video connectors, PS/2 connectors and USB connector.

BRIEF SUMMARY OF THE INVENTION

The primary objective of the present invention is to provide a KVM cable with video connectors, PS/2 connectors and USB connector capable of being used to connect a computer and a KVM device, in which, the un-used pins, the ground pins and the un-connected pins of the video connector are utilized, and a detecting resistor and a diode device are disposed in the USB connector, therefore, when the KVM cable is used, a user can selectively connect the PS/2 connector or the USB connector of the KVM cable to the computer, such that the user is able to control two or more computers through the KVM device.

Accordingly, to achieve the abovementioned primary objective, the inventor proposes a KVM cable with video connectors, PS/2 connectors and USB connector, comprising:

a first video connector, used for connecting to a video connection port of a KVM device;

a second video connector, used for connecting to a video connection port of a computer;

a main cable, connected with the first video connector and the second video connector, and adopted for transmitting signals between the first video connector and the second video connector;

a first branch cable, one terminal thereof extending from the main cable and is connected with the second video connector;

a first PS/2 connector, connected with the another terminal of the first branch cable and used for connecting to a first PS/2 connection port of the computer;

a second branch cable, one terminal thereof extending from the main cable and is connected with the second video connector;

a second PS/2 connector, connected with the another terminal of the second branch cable and used for connecting to a second PS/2 connection port of the computer; and at least one USB connector, connected to the second video connector through a third branch cable extending from the main cable and used for connecting to an USB connector of the computer;

wherein by way of the first branch cable, a first un-used pin, a first un-connected pin, a second un-connected pin, and a first ground pin of the first video connector may electrically connect to a first PS/2 data pin, a first PS/2 clock pin, a first PS/2 voltage pin, and a first PS/2 ground pin of the first PS/2 connector, respectively; moreover, by means of the first branch cable, the first video connector and the third branch cable, the first PS/2 data pin, the first PS/2 clock pin, the first PS/2 voltage pin, and the first PS/2 ground pin of the first PS/2 connector can electrically connect to an USB negative data pin, an USB positive data pin, an USB voltage pin, and an USB ground pin of the USB connector, respectively;

wherein a diode device is disposed between the first PS/2 voltage pin and the USB voltage pin; in addition, one end of a detecting resistor is coupled to the diode device and the USB voltage pin, and the another end of the detecting resistor is electrically connected to a second ground pin of the first video connector.

BRIEF DESCRIPTION OF THE SEVERAL VIEWS OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE INVENTION

To more clearly describe a KVM cable with video connectors, PS/2 connectors and USB connector according to the present invention, embodiments of the present invention will be described in detail with reference to the attached drawings hereinafter.

Figure 1:
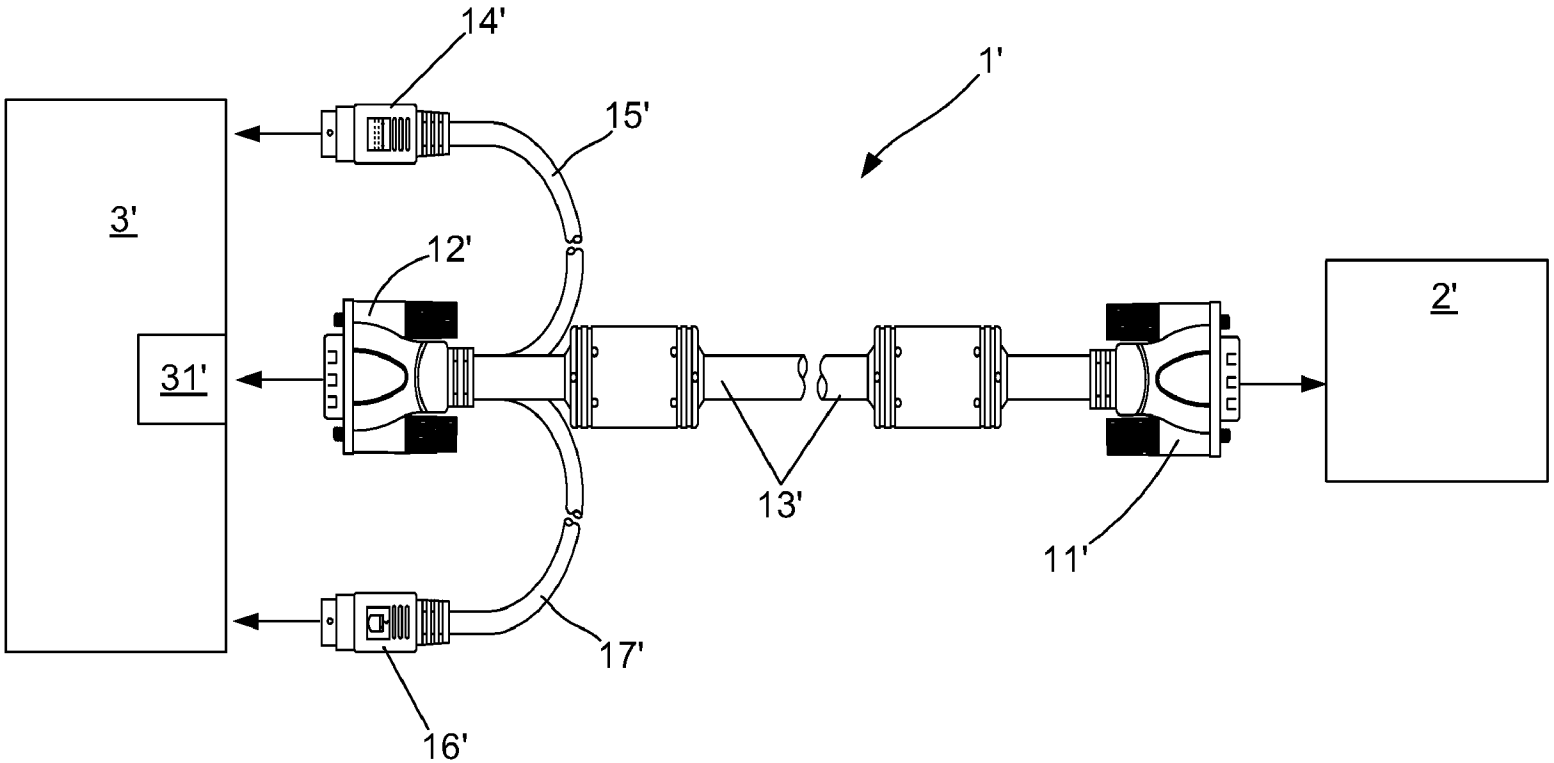
FIG. 1 (Prior Art)
FIG. 1 is a top view of a conventional KVM cable with multi functions.
Figure 2:
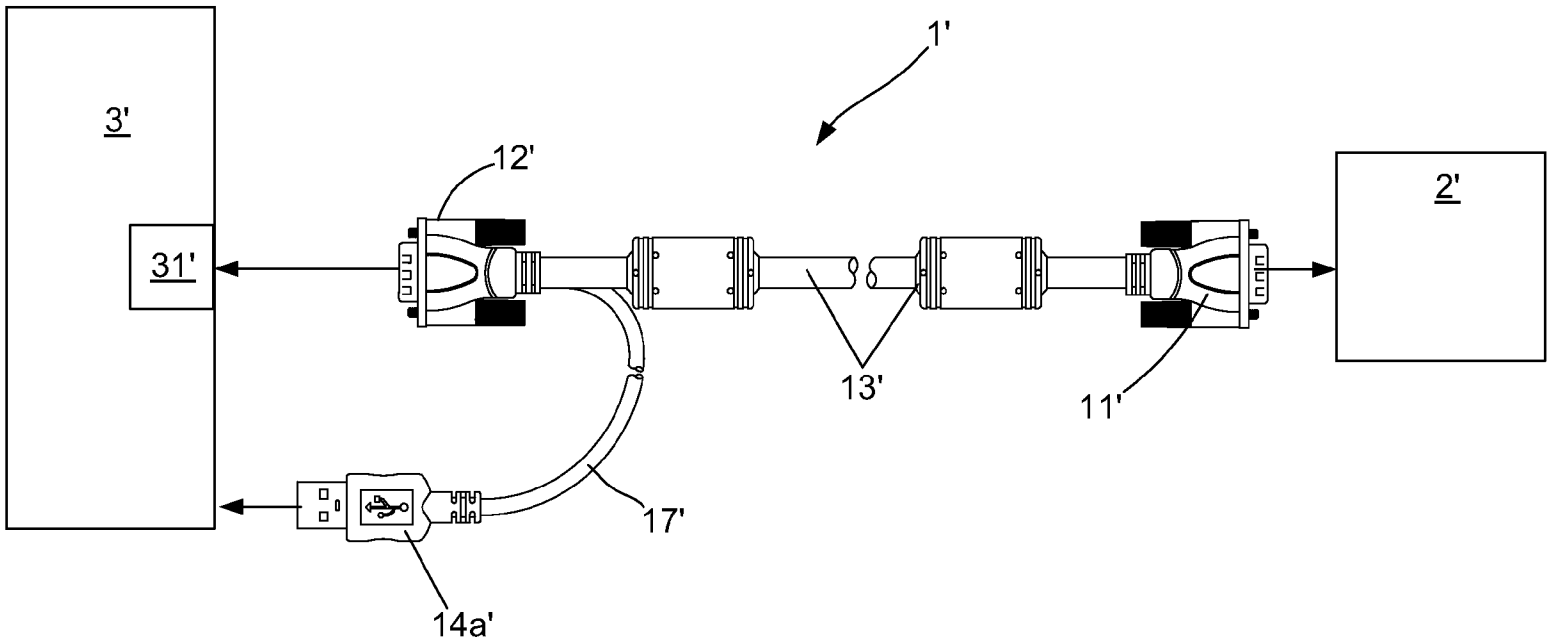
FIG. 2 (Prior Art)
FIG. 2 is the top view of a conventional KVM cable with multi functions and an USB connector.
Figure 3:
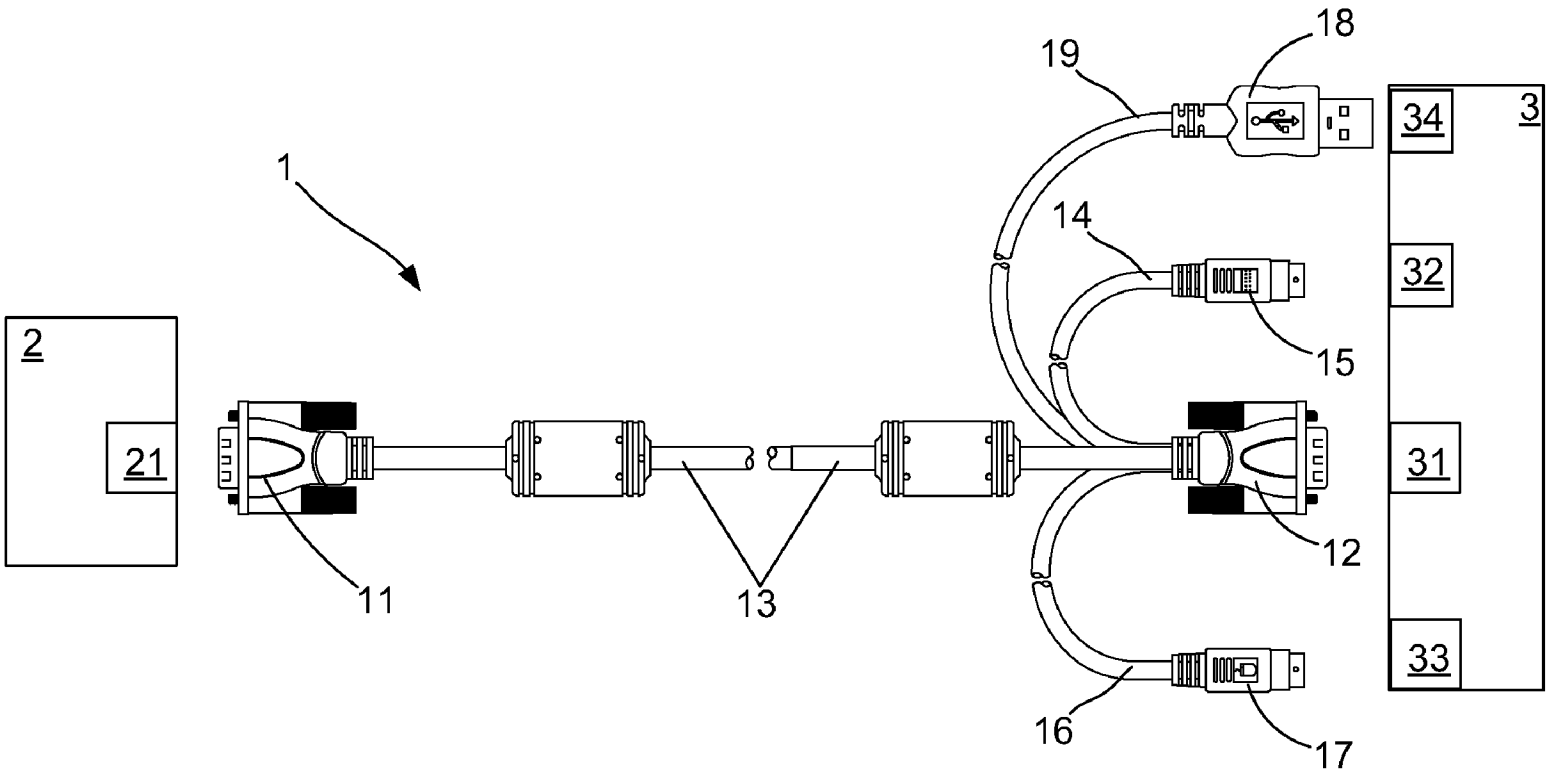
FIG. 3 is the top view of a KVM cable with video connectors, PS/2 connectors and USB connector according to the present invention.

Please refer to FIG. 3, which illustrates a top view of a KVM cable with video connectors, PS/2 connectors and USB connector according to the present invention. As shown in FIG. 3, the KVM cable 1 with the video connectors, the PS/2 connectors and the USB connector includes: a first video connector 11, a second video connector 12, a main cable 13, a first branch cable 14, a first PS/2 connector 15, a second branch cable 16, a second PS/2 connector 17, and an USB connector 18. The first video connector 11 and the second video connector 12 are the same kind of video connector, both the first video connector 11 and the second video connector 12 can be a VGA connector, a DVI connector or an HDMI connector; however, in the embodiment of the KVM cable 1, the VGA connector with 15 pins is used as the first video connector 11 and the second video connector 12. Moreover, as shown in FIG. 3, the first video connector 11 is used for connecting to a video connection port 21 of a KVM device 2, and the second video connector 12 is used for connecting to a video connection port 31 of a computer 3.

The main cable 13 is connected with the first video connector 11 and the second video connector 12, and adopted for transmitting signals between the first video connector 11 and the second video connector 12. One terminal of the first branch cable 14 extends from the main cable 13 and is connected with the second video connector 12, moreover, the another terminal of the first branch cable 14 is connected with the first PS/2 connector 15, such that the first PS/2 connector 15 can be used for connecting to a first PS/2 connection port 32 of the computer 3, so as to transmit a keyboard input/output data. Similar to the first branch cable 14, One terminal of the second branch cable 16 extends from the main cable 13 and is connected with the second video connector 12, in addition, the another terminal of the second branch cable 16 is connected with the second PS/2 connector 17, so that, the second PS/2 connector 17 can be used for connecting to a second PS/2 connection port 33 of the computer 3, so as to transmit a mouse input/output data. Moreover, the USB connector 18 is connected to the second video connector 12 through the third branch cable 19 extending from the main cable 13, wherein the USB connector 18 is used for connecting to an USB connection port 34 of the computer 3.

Figure 4A:
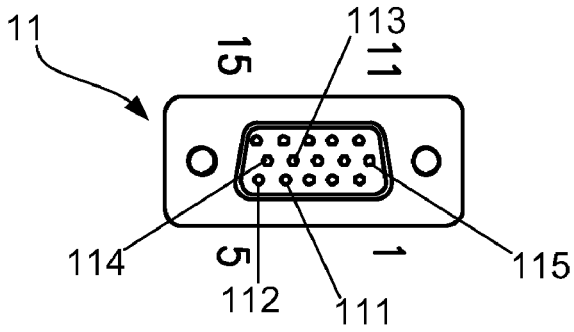
FIG. 4A is a front view of a VGA connector.
Figure 4B:
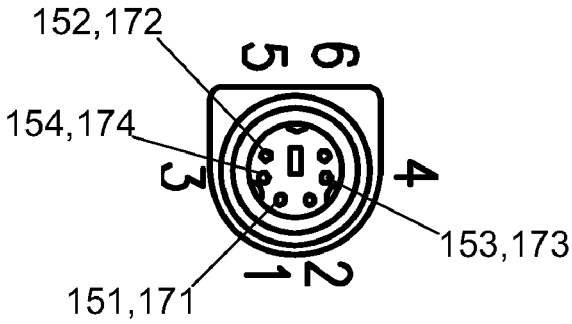
FIG. 4B is the front view of a PS/2 connector.
Figure 4C:
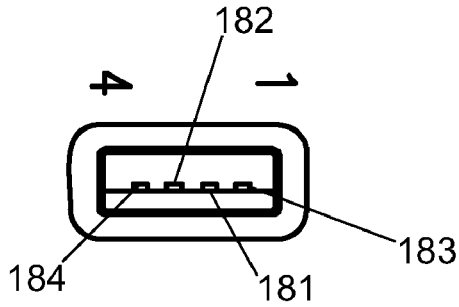
FIG. 4C is the front view of an USB connector.

Referring to FIG. 3 again, and simultaneously refer to FIG. 4A, FIG. 4B and FIG. 4C, which illustrate the front views of a VGA connector, a PS/2 connector and an USB connector. As shown in FIG. 4A, for the first video connector 11 having 15 pins, the 15 pins thereof are arranged in three rows and the representative pin code 1, 5, 11, and 15 are marked in FIG. 4A. In the first video connector 11, the pin with pin code 4 as a first un-used pin 111, the pin with pin code 5 as a first un-connected pin 111, the pin with pin code 6 as a second ground pin 115, the pin with pin code 9 as a second un-connected pin 113, and the pin with pin code 10 as a first ground pin 114.

Besides, as shown in FIG. 4B, for the first PS/2 connector 15 with 6 pins, the 6 pins thereof are arranged in circularity and the pin codes 1-6 are marked in FIG. 4B. In the first PS/2 connector 15, the pin with pin code 1 as a first PS/2 data pin 151, the pin with pin code 3 as a first PS/2 ground pin 154, the pin with pin code 4 as a first PS/2 voltage pin 153, and the pin with pin code 5 as a first PS/2 clock pin 152. Moreover, it must be especially noted that, the pin number and the relative pin code of the second PS/2 connector 17 are the same to the pin number and the pin code of the first PS/2 connector 15; therefore, as shown in FIG. 4B, in the second PS/2 connector 17, the pin with pin code 1 as a second PS/2 data pin 171, the pin with pin code 3 as a second PS/2 ground pin 174, the pin with pin code 4 as a second PS/2 voltage pin 173, and the pin with pin code 5 as a second PS/2 clock pin 172.

In addition, as shown in FIG. 4C, for the USB connector 18 with 4 pins, the 4 pins thereof are arranged in one row and the pin codes 1-4 are marked in FIG. 4C. Moreover, in the USB connector 18, the pin with pin code 1 as an USB voltage pin 183, the pin with pin code 2 as an USB negative data pin 181, the pin with pin code 3 as an USB positive data pin 182, and the pin with pin code 4 as an USB ground pin 184.

Thus, through the descriptions of the pin number, pin code and pin definition of the first video connector 11, the first PS/2 connector 15, the second PS/2 connector 17, and the USB connector 18, it is helpful to understand how the USB connector 18 and the second PS/2 connector 17 are integrated in the first video connector 11 in the present invention. Please refer to FIG. 3, FIG. 4A, FIG. 4B, and FIG. 4C again, and simultaneously refer to FIG. 5*m* which illustrates a schematic diagram of the pin connection between the first video connector, the second PS/2 connector, the first PS/2 connector, and the USB connector of the KVM cable according to the present invention. As shown in FIG. 3, FIGS. 4A-4C and FIG. 5, in the KVM cable 1 of the present invention, by way of the first branch cable 14, the first un-used pin 111, the first un-connected pin 112, the second un-connected pin 113, and the first ground pin 114 of the first video connector 11 may electrically connect to the first PS/2 data pin 151, the first PS/2 clock pin 152, the first PS/2 voltage pin 153, and the first PS/2 ground pin 154 of the first PS/2 connector 15, respectively; Moreover, by means of the first branch cable 14, the first video connector 11 and the third branch cable 19, the first PS/2 data pin 151, the first PS/2 clock pin 152, the first PS/2 voltage pin 153, and the first PS/2 ground pin 154 of the first PS/2 connector 15 can electrically connect to the USB negative data pin 181, the USB positive data pin 182, the USB voltage pin 183, and the USB ground pin 184 of the USB connector 18, respectively.

Figure 5:
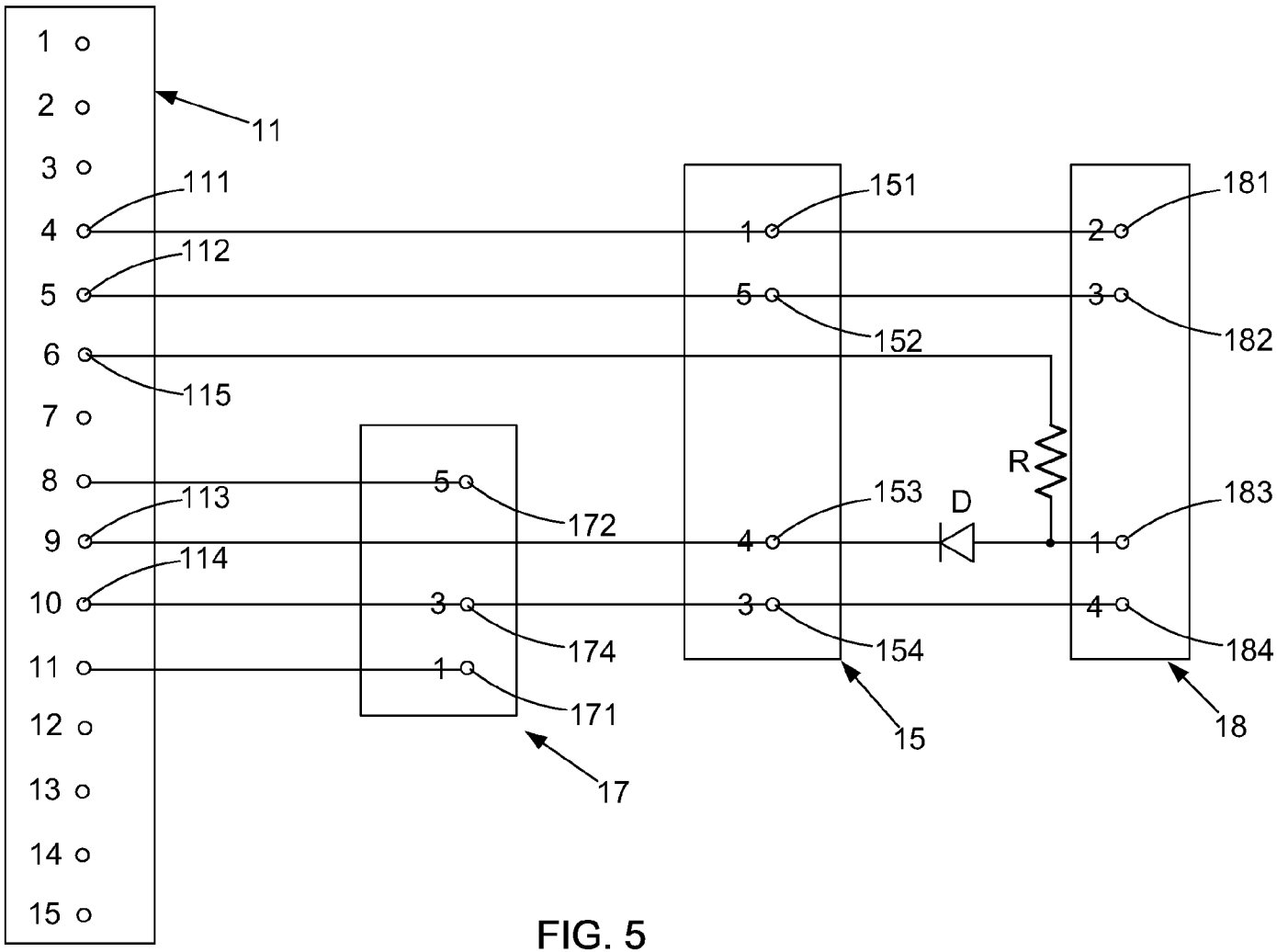
FIG. 5 is a schematic diagram of the pin connection between a first video connector, a second PS/2 connector, a first PS/2 connector, and an USB connector of the KVM cable with video connectors, PS/2 connectors and USB connector according to the present invention.

Continuously refer to FIG. 3, FIGS. 4A-4C and FIG. 5, as shown in FIG. 5, a diode device D is disposed between the first PS/2 voltage pin 153 and the USB voltage pin 183; besides, one end of a detecting resistor R is coupled to the diode device D and the USB voltage pin 183, and the another end of the detecting resistor R is electrically connected to the second ground pin 115 of the first video connector 11. Thus, by way of disposing the detecting resistor R and the diode device D in the USB connector 18, the user is capable of selectively connecting the PS/2 connector or the USB connector to the computer 3 when the KVM cable 1 is used.

For more clearly introduce how to dispose the detecting resistor R and the diode device D in the KVM cable 1, please refer to FIG. 3, FIGS. 4A-4C and FIG. 5 again, in the KVM cable 1 of the present invention, the second ground pin 115 of the first video connector 11 is further used as a level detecting pin, and the second un-connected pin 113 of the first video connector 11 is further used as a voltage supply pin adopted for supplying voltage to the first PS/2 voltage pin 153 and the USB voltage pin 183. Wherein when the USB connector 18 is connected to the USB connection port 34 of the computer 3, the second ground pin 115 detects a high level signal through the detecting resistor R, such that the computer 3 is aware that the connector connected to the USB connection port 34 thereof is an USB connector; meanwhile, the computer 3 would transmit a keyboard input/output data to the main cable 13 via the USB negative data pin 181 and the USB positive data pin 182, and the first video connector 11 further transmits the keyboard input/output data to the KVM device 2.

Furthermore, when the second PS/2 connector 17 is connected to the second PS/2 connection port 33 of the computer 3, the computer 3 is able to transmit a mouse input/output data to the main cable 13 via the second PS/2 data pin 171 of the second PS/2 connector 17, and then the first video connector 11 would further transmit the mouse input/output data to the KVM device 2. During the condition of the second PS/2 connector 17 being connected to the computer 3, in the meantime, when the first PS/2 connector 15 is simultaneously connected to the first PS/2 connection port 32 of the computer 3, the second ground pin 115 can not detect the high level signal through the detecting resistor R, therefore, the computer 3 is able to know that the connector connected to the first PS/2 connection port 32 is a PS/2 connector; meanwhile, the computer 3 would transmit the keyboard input/output data to the main cable 13 via the first PS/2 data pin 151 of the first PS/2 connector 15, and the first video connector 11 further transmits the keyboard input/output data to the KVM device 2.

Thus, through the above descriptions, the KVM cable with the video connectors, the PS/2 connectors and the USB connector of the present invention has been disclosed completely and clearly in the above description. In summary, the present invention has the following advantages:

1. In the present invention, two PS/2 connectors and one USB connector are integrated in the identical KVM cable, that facilitate the user selectively connect a mouse with PS/2 interface and a keyboard with PS/2 interface to the computer or connect a keyboard/mouse with USB interface to the computer.
2. By way of utilizing the un-used pins, the ground pins and the un-connected pins of the first video connector and disposing the detecting resistor and the diode device in the USB connector, the computer is aware that the connector connected to the connection port thereof is a connector with PS/2 interface or a connector with USB interface by using the level detecting pin of the first video connector to detect the high level signal.
3. Inheriting to the above point 2, no matter the first video connector and the second video connector are a VGA connector, a DVI connector or an HDMI connector, the un-used pins, the ground pins and the un-connected pins of the first video connector can also be utilized and the detecting resistor and the diode device can also be disposed in the USB connector, such that the computer can aware that the connector connected to the connection port thereof is a connector with PS/2 interface or a connector with USB interface by way of using the level detecting pin of the first video connector to detect the high level signal.

The above description is made on embodiments of the present invention. However, the embodiments are not intended to limit scope of the present invention, and all equivalent implementations or alterations within the spirit of the present invention still fall within the scope of the present invention.

I claim:

1. A KVM cable with video connectors, PS/2 connectors and USB connector, comprising:

a first video connector, being used for connecting to a video connection port of a KVM device;

a second video connector, being used for connecting to a video connection port of a computer;

a main cable, being connected with the first video connector and the second video connector, and adopted for transmitting signals between the first video connector and the second video connector;

a first branch cable, one terminal thereof extending from the main cable and being connected with the second video connector;

a first PS/2 connector, being connected with the another terminal of the first branch cable, and used for connecting to a first PS/2 connection port of the computer;

a second branch cable, one terminal thereof extending from the main cable and being connected with the second video connector;

a second PS/2 connector, being connected with the another terminal of the second branch cable and used for connecting to a second PS/2 connection port of the computer; and at least one USB connector, being connected to the second video connector through a third branch cable extending from the main cable and used for connecting to an USB connection port of the computer;

wherein by way of the first branch cable, a first un-used pin, a first un-connected pin, a second un-connected pin, and a first ground pin of the first video connector may electrically connect to a first PS/2 data pin, a first PS/2 clock pin, a first PS/2 voltage pin, and a first PS/2 ground pin of the first PS/2 connector, respectively; moreover, by means of the first branch cable, the first video connector and the third branch cable, the first PS/2 data pin, the first PS/2 clock pin, the first PS/2 voltage pin, and the first PS/2 ground pin of the first PS/2 connector can electrically connect to an USB negative data pin, an USB positive data pin, an USB voltage pin, and an USB ground pin of the USB connector, respectively;

wherein a diode device is disposed between the first PS/2 voltage pin and the USB voltage pin; in addition, one end of a detecting resistor being coupled to the diode device and the USB voltage pin, and the another end of the detecting resistor being electrically connected to a second ground pin of the first video connector;

wherein the data transmitted by the PS/2 connectors and the USB connector is selected from the group consisting of: a keyboard input/output data and a mouse input/output data.

2. The KVM cable with the video connectors, the PS/2 connectors and the USB connector of claim 1, wherein the first video connector is selected from the group consisting of: VGA connector, DVI connector and HDMI connector.

3. The KVM cable with the video connectors, the PS/2 connectors and the USB connector of claim 1, wherein the second video connector is selected from the group consisting of: VGA connector, DVI connector and HDMI connector.

4. The KVM cable with the video connectors, the PS/2 connectors and the USB connector of claim 1, wherein the first PS/2 connector is adopted for transmitting a keyboard input/output data.

5. The KVM cable with the video connectors, the PS/2 connectors and the USB connector of claim 1, wherein the second PS/2 connector is adopted for transmitting a mouse input/output data.

6. The KVM cable with the video connectors, the PS/2 connectors and the USB connector of claim 1, wherein the second ground pin is used as a level detecting pin.

7. The KVM cable with the video connectors, the PS/2 connectors and the USB connector of claim 6, wherein when the USB connector is connected to the USB connection port of the computer, the second ground pin detecting a high level signal via the detecting resistor.

8. The KVM cable with the video connectors, the PS/2 connectors and the USB connector of claim 7, wherein when the second PS/2 connector and the first PS/2 connector are simultaneously connected to the second PS/2 connection port and the first PS/2 connection port of the computer, the second ground pin can not detect the high level signal through the detecting resistor.

9. The KVM cable with the video connectors, the PS/2 connectors and the USB connector of claim 7, wherein the second un-connected pin is used as a voltage supply pin adopted for supplying voltage to the first PS/2 voltage pin and the USB voltage pin.

* * * * *